United States Patent [19]

Mills et al.

[11] Patent Number: 4,678,191

[45] Date of Patent: Jul. 7, 1987

[54] MULTIPLE DICE GAME

[76] Inventors: Sean R. Mills; George Spector, both of 233 Broadway Rm 3615, New York, N.Y. 10007

[21] Appl. No.: 784,584

[22] Filed: Oct. 4, 1985

[51] Int. Cl.[4] ..... A63F 9/04

[52] U.S. Cl. ..... 273/146

[58] Field of Search ..... 273/146; 434/104, 115

[56] References Cited

U.S. PATENT DOCUMENTS 2,558,591 6/1951 Starck ..... 446/115

3,614,105 8/1986 Dandini ..... 273/146

3,924,376 12/1975 Tsurumi ..... 273/146

*Primary Examiner*—Richard C. Pinkham

*Assistant Examiner*—Gary Jackson

[57] ABSTRACT

A multi-player game of chance is provided and consists of a set of five chips for each player of the game, a pot for holding various amounts of the chips during the course of the game and five identification devices bearing identifying indicia. Each device is capable of being manipulated to indicate random placement of each chip of each player within the container and to other players until one player is left with at least one chip to win all of the chips within the pot.

3 Claims, 8 Drawing Figures

MULTIPLE DICE GAME

BACKGROUND OF THE INVENTION

The instant invention relates generally to games and more specifically it relates to a multi-player game of chance.

Numerous games have been provided in prior art that are adapted to provide entertainment to all the players. For example, U.S. Pat. Nos. 4,123,062; 4,286,787 and 4,342,458 all are illustrative of such prior art. While these units may be suitable for the particular purpose to which they address, they would not be as suitable for the purposes of the present invention as heretofore described.

SUMMARY OF THE INVENTION

A principle object of the present invention is to provide a multi-player game of chance utilizing a plurality of discrete identification devices bearing identifying indicia and which are capable of being manipulated.

Another object is to provide a multi-player game of chance having chips, a container being the pot and five discrete identification devices which are unusual dice.

An additional object is to provide a multi-player game of chance wherein the unusual dice can have various combinations of indicia printed thereon to determine play positons of the chips when the dice are manipulated.

A further object is to provide a multi-player game of chance that is economical in cost to manufacture.

A still further object is to provide a multi-player game of chance that is simple and easy to use.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
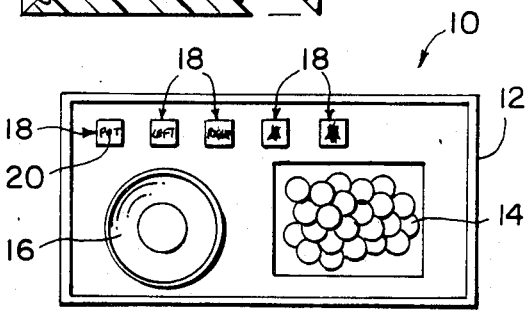
FIG. 1 is a top plan view of a box containing the various components forming the game apparatus of the present invention.

Turning now descriptively to the drawings, in which similar reference characters denote similar elements throughout the several views, FIG. 1 illustrates a multi-player game of chance 10 within a box 12 that contains a set of five chips 14 for each player of the game, a pot 16 for holding various amounts of the chips 14 during the course of the game and five identification devices 18 bearing identifying indicia 20.

Each device 18 is capable of being manipulated to indicate random placement of each chip 14 of each player within the pot 16 and to other players. When one player is left with at least one chip 14 he wins all of the chips within the pot 16.

Figure 2:
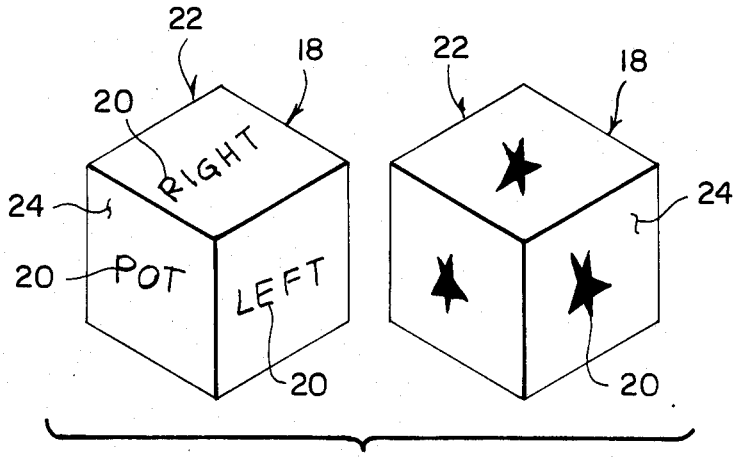
FIG. 2 is a perspective view of two of the five dice of the invention showing all six sides thereon in greater detail.

As best seen in FIG. 2 each identification device 18 is a cube 22. Each face 24 of the cube 22 bears a different identifying indicia 20 such as the words "pot", "left", "right" and the star symbol.

Figure 3:
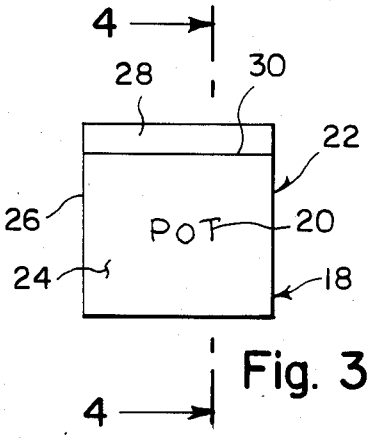
FIG. 3 is a side view of a first modification.
Figure 4:
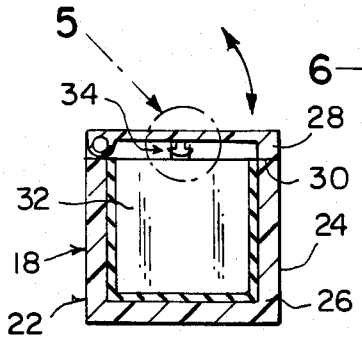
FIG. 4 is a cross sectional view taken along line 4—4 in FIG. 3 showing a removable insert within a shell so that various combinations printed on shells can be utilized for the game.

In FIGS. 3 and 4 the cube 22 contains a hollow shell 26 that has a hinged lid 28 on one side 30 with various combinations of the identifying indicia 20 provided on the faces 24 of the shell 26. A removable insert 32 is placed within the hollow shell 26 so that proper weight can be added to the shell 26 when the device 18 is manipulated by tossing and rolling of the cube 22.

Figure 5:
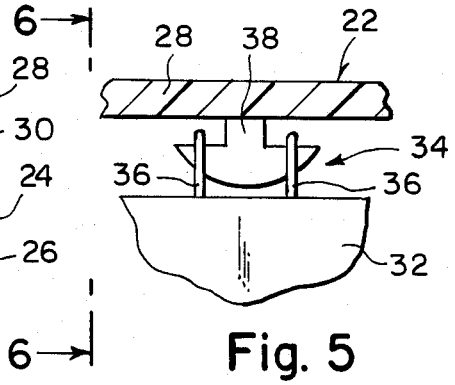
FIG. 5 is a detail indicated in FIG. 4 by numeral 5 showing a snap on locking device from the lide to the insert.
Figure 6:
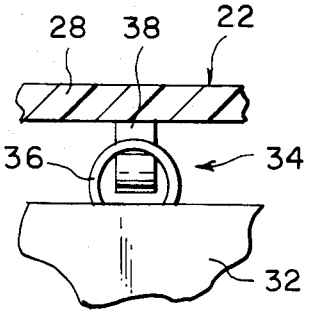
FIG. 6 is a side view taken along line 6—6 in FIG. 5 showing one of the rings thereon.

As best seen in FIGS. 5 and 6 the cube 22 further contains a snap on locking device 34 from the lid 28 to the insert 32 securing the insert. When the lid 28 is opened the insert will be removed from the shell 26. The locking device 34 consists of a pair of spaced rings 36 attached to top of the insert 32 and a male engaging member 38 attached to bottom of the lid 28 so that when the lid is initially closed over the insert the male engaging member 38 will engage the rings 36.

Figure 7:
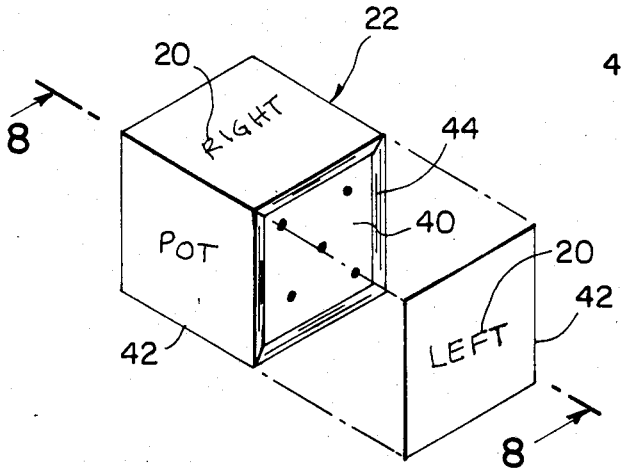
FIG. 7 is a perspective view partly exploded of a second modification.
Figure 8:
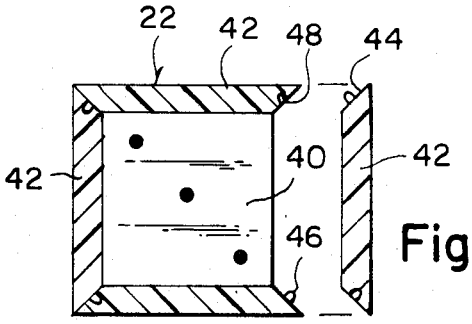
FIG. 8 is a cross sectional view partly exploded taken along line 8—8 in FIG. 7 showing all sides snaping together around a standard die whereby various combinations can be made.

FIGS. 7 and 8 show another structure to cube 22 wherein the cube consists of a standard die 40 and six attachable side members 42. Each side member 42 has one identifying indicia 20 thereon. The six attachable side members 42 can be placed around the standard die 40 to form various combinations of the identifying indicia 20.

Each attachable side member 42 further has beveled edges 44 and integral male and female snap locking members 46 and 48 so that the six attachable side members 42 can snap securely together around the standard die to form the cube 22.

The rules for playing the multi-player game of chance 10 are as follows:

1. The number of players is three or more for ages four and up.
2. Each player starts out with 5 chips.
3. For the first round player number one rolls all five cubes 22 at one time.
4. Whatever comes up on the cubes 22 that player does. For example "LEFT", "RIGHT", "POT", "STAR" and "STAR" means the player would pass one chip to the player sitting on his left, one chip to the player sitting on his right and put one in the pot 16. The two stars indicate that he keep two of his chips.
5. Player number two would then roll all five cubes 22 at one time. He gets "LEFT", "LEFT", "POT" and "STAR". He would then pass two chips 14 to the player on his left, put two chips in the pot 16 and keep his remaining two chips because he received one from player number one.

6. Each remaining player would then roll all five cubes 22 at one time and do what the cubes indicate.
7. After the first round of rolling the cubes, each player will then roll only the number of cubes 22 equal to the number of chips 14 he has up to five.
8. If a player has no chips when it comes to his turn to roll he passes his turn and hopes to get some when the player on his right or left rolls.
9. Nobody is out of the game until only one player has one or more chips 14 left.
10. The last player with chips left wins all of the chips 14 in the pot 16 and the game 10 starts over.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A multi-player game of chance comprising:

(a) a set of five chips for each said player of said game;

(b) a pot for holding various amounts of said chips during the course of said game; and (c) five indentification devices bearing identifying indicia, each said device capable of being manipulated to indicate random placement of each said chip of each said player within said pot and to other said players until one said player is left with at least one said chip to win all of said chips within said pot, wherein each said identification device is a cube, each face of said cube bearing different identifying indicia, and each said cube comprises:

(a) a hollow shell having a hinged lid on one side with various combinations of said identifying indicia provided on said faces of said shell; and (b) a removeable insert placed within said hollow shell so that proper weight can be added to said shell when said device is manipulated by tossing and rolling of said cube.

2. A multi-player game of chance as recited in claim 1, wherein each said cube further comprises a snap on locking device from said lid to said insert securing said insert so that when said lid is opened said insert will be removed from said shell.

3. A multi-player game of chance comprising:

(a) a set of five chips for each said player of said game;

(b) a pot for holding various amounts of said chips during the course of said game;

(c) five indentification devices bearing identifying indicia, each said device capable of being manipulated to indicate random placement of each said chip of each said player within said pot and to other said players until one said player is left with at least one said chip to win all of said chips within said pot, wherein each said identification device is a cube, each face of said cube bearing different identifying indicia, wherein each said cube comprises;

(d) a standard die; and (e) six attachable side members, each said side member having one identifying indicia thereon so that said six attachable side members can be placed around said standard die to form various combinations of said identifying indicia, wherein each said attachable side member further having beveled edges and integral male and female snap locking members so that said six attachable side members can snap securely together around said standard die to form said cube.

* * * * *